US009587531B2

(12) United States Patent
Choi et al.

(10) Patent No.: US 9,587,531 B2
(45) Date of Patent: Mar. 7, 2017

(54) VARIABLE VALVE LIFT APPARATUS

(71) Applicant: Hyundai Motor Company, Seoul (KR)

(72) Inventors: Myungsik Choi, Seoul (KR); Won Gyu Kim, Seoul (KR); Young Hong Kwak, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/957,104

(22) Filed: Dec. 2, 2015

(65) Prior Publication Data

US 2016/0160708 A1 Jun. 9, 2016

(30) Foreign Application Priority Data

Dec. 4, 2014 (KR) ..... 10-2014-0172872

(51) Int. Cl.

| | |
|---|---|
| ***F01L 1/18*** | (2006.01) |
| ***F01L 13/00*** | (2006.01) |
| *F01L 1/26* | (2006.01) |
| *F01L 1/46* | (2006.01) |

(52) U.S. Cl.

CPC ..... *F01L 13/0047* (2013.01); *F01L 1/185* (2013.01); *F01L 13/0005* (2013.01); *F01L 13/0036* (2013.01); *F01L 1/18* (2013.01); *F01L 1/267* (2013.01); *F01L 2001/186* (2013.01); *F01L 2001/467* (2013.01); *F01L 2105/00* (2013.01)

(58) Field of Classification Search

CPC ... F01L 1/18; F01L 1/185; F01L 1/267; F01L 13/0005; F01L 13/0036; F01L 13/0047; F01L 2001/186

USPC ..... 123/90.39, 90.44, 90.45

See application file for complete search history.

(56) References Cited

U.S. PATENT DOCUMENTS

| | | | | |
|---|---|---|---|---|
| 8,028,668 | B2 * | 10/2011 | Choi | F01L 1/18 123/90.39 |
| 2009/0145389 | A1 | 6/2009 | Choi | |
| 2012/0137998 | A1 | 6/2012 | Choi | |
| 2013/0146008 | A1 | 6/2013 | Stoody | |
| 2013/0220250 | A1 | 8/2013 | Gunnel et al. | |

FOREIGN PATENT DOCUMENTS

| | | |
|---|---|---|
| DE | 20 2007 013 508 U1 | 1/2008 |
| DE | 10 2008 019 904 A1 | 6/2009 |
| DE | 10 2010 052 551 A1 | 5/2012 |
| DE | 10 2011 051 694 A1 | 6/2012 |
| EP | 0 420 159 A1 | 4/1991 |

(Continued)

*Primary Examiner* — Ching Chang

(74) *Attorney, Agent, or Firm* — Morgan, Lewis & Bockius LLP

(57) ABSTRACT

A variable valve lift apparatus may include: an outer body selectively making a lever motion according to rotation of a cam, a first inner body disposed in the any one inside space of the outer body and adapted, a second inner body disposed in the other one inside space of the outer body, a connecting shaft disposed to penetrate the one end of the outer body, the one end of the first inner body, and the one end of the second inner body and connect the outer body with the first and second inner bodies, a first lost motion spring to return the first inner body relatively rotated with the outer body around the connecting shaft, and a second lost motion spring to return the second inner body relatively rotated with the outer body around the connecting shaft.

12 Claims, 6 Drawing Sheets

(56) References Cited

FOREIGN PATENT DOCUMENTS

| | | | |
|---|---|---|---|
| EP | 2 006 498 | A1 | 12/2008 |
| JP | 06-033720 | A | 2/1994 |
| JP | 2008-309040 | A | 12/2008 |
| JP | 4286235 | B2 | 6/2009 |
| JP | 2009-150232 | A | 7/2009 |
| JP | 2010-209777 | A | 9/2010 |
| JP | 2014-101814 | A | 6/2014 |
| KR | 10-0980867 | B1 | 9/2010 |
| KR | 10-0980870 | B1 | 9/2010 |
| KR | 10-2010-0130895 | A | 12/2010 |
| KR | 10-1080790 | B1 | 11/2011 |

* cited by examiner

VARIABLE VALVE LIFT APPARATUS

CROSS-REFERENCE TO RELATED APPLICATION

The present application claims priority to and the benefit of Korean Patent Application No. 10-2014-0172872 filed on Dec. 4, 2014, the entire contents of which is incorporated herein for all purposes by this reference.

BACKGROUND OF THE INVENTION

Field of the Invention

The present invention relates to a variable valve lift apparatus. More particularly, the present invention relates to a variable valve lift apparatus which varies lift of a valve by three steps.

Description of Related Art

Generally, an internal combustion engine receives fuel and air into a combustion chamber and generates power by combusting the fuel and the air. Herein, an intake valve is operated by drive of a camshaft, and air flows into the combustion chamber during when the intake valve is open. In addition, an exhaust valve is operated by drive of a camshaft, and air is exhausted from the combustion chamber while the exhaust valve is open.

Meanwhile, optimal operations of the intake valve or the exhaust valve are determined according to rotation speed of the engine. That is, lift and open/close timing of the valves are properly controlled according to rotation speed of the engine. A variable valve lift (VVL) apparatus has been developed in which the valves are operated for various lifts according to rotation speed of the engine for realizing optimal operations of the valves according to rotation speed of the engine. For example, there is a variable valve lift apparatus in which a plurality of cams for operating the valves by each different lift are provided to the camshaft, and the cam operating the valves is selected according to conditions.

When the plurality of cams are provided to the camshaft, however, the composition for selectively changing the cam to operate the intake valve or the exhaust valve may become complex, and interference between the elements of the composition may occur. Meanwhile, in case the plurality of cams are respectively and independently operated for preventing the interference between the elements of the composition, an additional constituent element is required as each cam for operating the cam such that the cost may be increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable valve lift apparatus having advantages of varying lift of a valve by three steps which include zero lift for deactivating cylinder.

In addition, various aspects of the present invention are directed to providing a variable valve lift apparatus having further advantages of improving spatial utility and dynamic characteristic in spite of varying lift of two valves.

The variable valve lift apparatus according to an exemplary embodiment of the present invention may include: an outer body selectively making a lever motion according to rotation of a cam and being adapted such that the valve is connected with one end thereof and a pivot axis of the lever motion is disposed at the other end thereof; a first inner body disposed in inside space of the outer body and adapted such that one end thereof rotatably connected with the one end of the outer body; a second inner body disposed in inside space of the outer body and adapted such that one end thereof rotatably connected with the one end of the outer body; a connecting shaft disposed so as to penetrate the one end of the outer body, the one end of the first inner body, and the one end of the second inner body and connect the outer body with the first and second inner bodies; a first lost motion spring provided so as to return the first inner body which is relatively rotated with the outer body around the connecting shaft; and a second lost motion spring provided so as to return the second inner body which is relatively rotated with the outer body around the connecting shaft.

The cam may have two cams, the first inner body may be selectively fixed to the outer body so as to make a lever motion together with the outer body around the pivot axis of the outer body lever motion depending on rotation of the any one cam of the two cam or may be selectively released from fixing with the outer body so as to make a lever motion around the connecting shaft depending on rotation of the any one cam, and the second inner body may be selectively fixed to the outer body so as to make a lever motion together with the outer body around the pivot axis of the outer body lever motion depending on rotation of the other one cam of the two cam or may be selectively released from fixing with the outer body so as to make a lever motion around the connecting shaft depending on rotation of the other one cam.

The outer body may form valve contact portions which are protruded from both sides of the one end thereof so as to respectively push one valve by the lever motion and seated portions which are protruded from both sides of the other end thereof so as to respectively seat one hydraulic lash adjuster.

The first inner body may form an inside space, and the variable valve lift apparatus may further include a roller which is disposed in the inside space of the first inner body, is rotatably connected with the first inner body, and is rolling-contacted to the any one cam such that the first inner body makes the lever motion depending on rotation of the any one cam.

A stopper may be respectively formed at the other end of the first inner body and the other end of the second inner body to be protruded for blocking the other end of the outer body when the first and second inner bodies are returned.

The first lost motion spring may be disposed so as to be coiled around the connecting shaft and be adapted such that one part thereof is fixed to the outer body and the other part thereof is fixed to the first inner body.

The one part of the first lost motion spring may be extended without interference with the first inner body so as to be fixed the one end of the outer body.

The second lost motion spring may be disposed so as to be coiled around the connecting shaft and be adapted such that one part thereof is fixed to the outer body and the other part thereof is fixed to the second inner body.

The one part of the second lost motion spring may be extended without interference by the second inner body so as to be fixed the one end of the outer body.

The variable valve lift apparatus may further include: a hydraulic pump generating hydraulic pressure; a first latching pin disposed at the outer body and operated so as to selectively fix the first inner body to the outer body by hydraulic pressure being generated the hydraulic pump; a second latching pin disposed at the outer body and operated so as to selectively fix the second inner body to the outer body by hydraulic pressure being generated the hydraulic pump; a first oil control valve controlling such that hydraulic pressure receiving from the hydraulic pump is selectively supplied to the first latching pin; and a second oil control valve controlling such that hydraulic pressure receiving from the hydraulic pump is selectively supplied to the second latching pin.

The first latching pin may be operated so as to fix the first inner body to the outer body as being pushed by hydraulic pressure when hydraulic pressure is supplied thereto and unfix the first inner body and the outer body to each other as being pushed by a spring when hydraulic pressure is released therefrom.

The second latching pin may be operated so as to unfix the second inner body and the outer body to each other as being pushed by hydraulic pressure when hydraulic pressure is supplied thereto and fix the second inner body to the outer body as being pushed by a spring when hydraulic pressure is released therefrom.

High lift of the valve may be realized in case the first inner body is fixed to the outer body.

Normal lift of the valve may be realized in case the first inner body and the outer body are unfixed to each other and the second inner body is fixed to the outer body.

Zero lift of the valve may be realized in case the first inner body and the outer body are unfixed to each other and the second inner body and the outer body are unfixed to each other.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
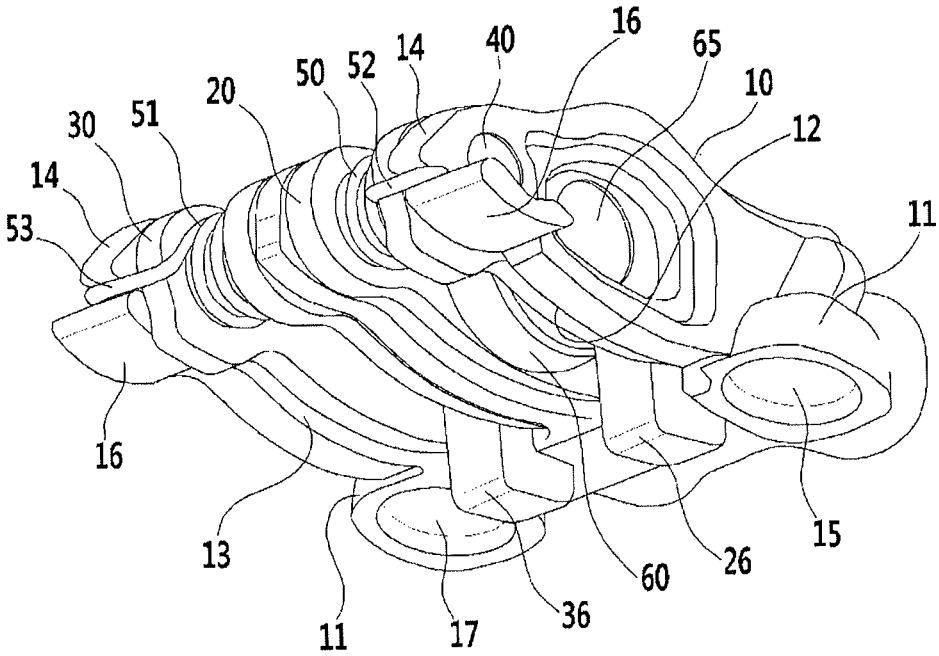
FIG. 1 is a perspective view of a variable valve lift apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
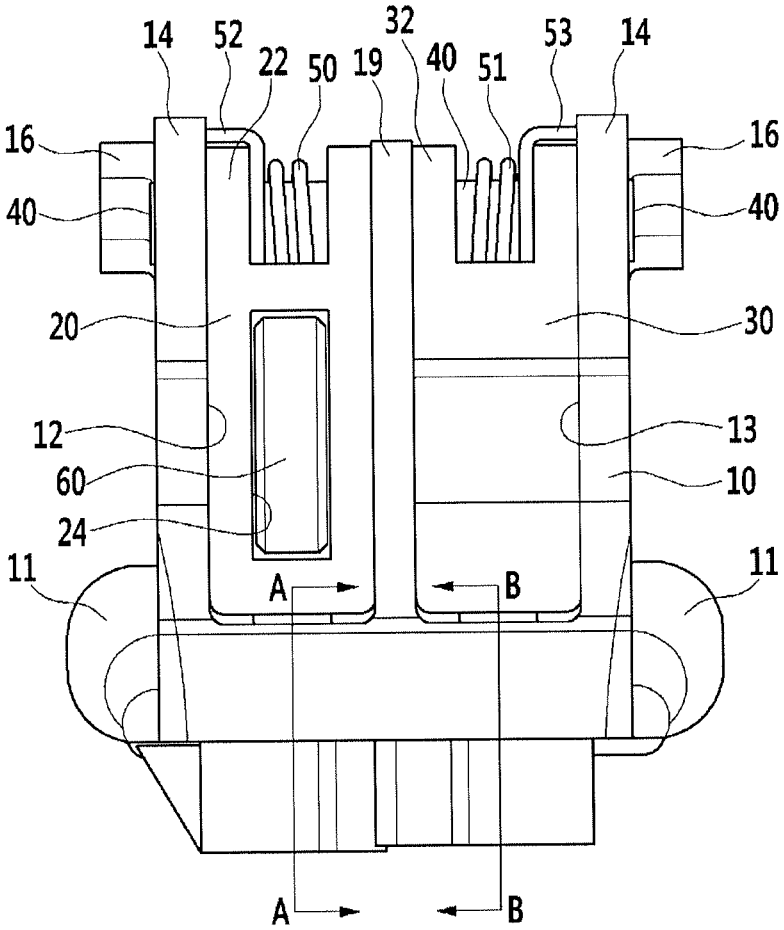
FIG. 2 is a top plan view of a variable valve lift apparatus according to an exemplary embodiment of the present invention.
Figure 3:
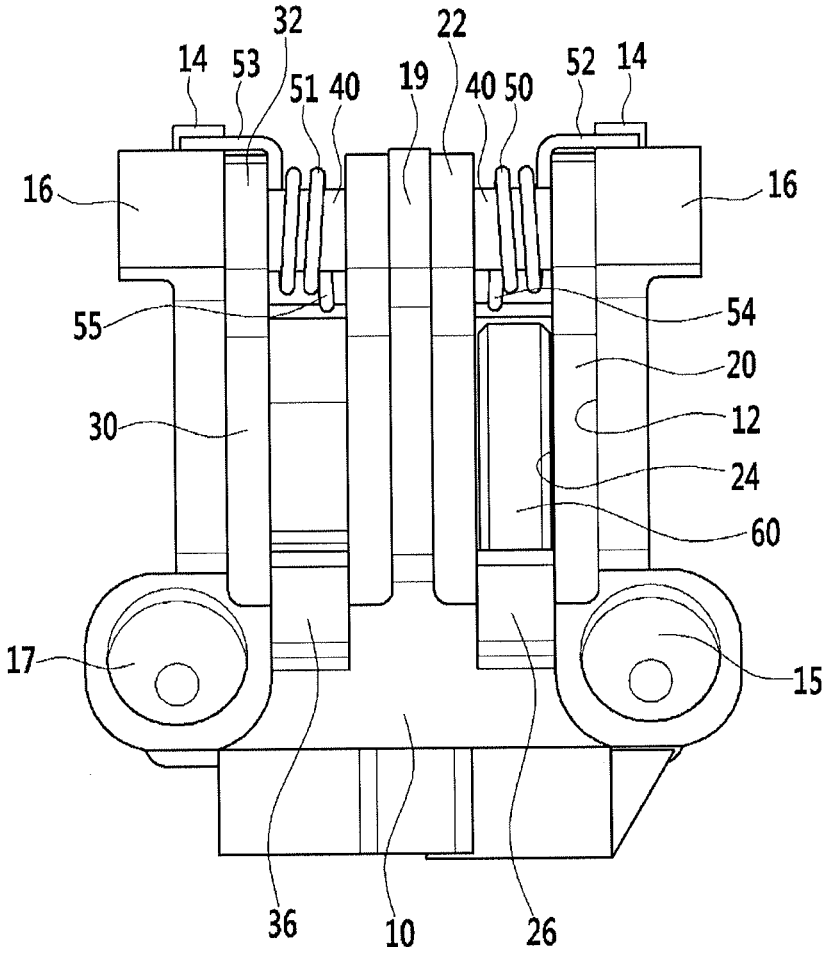
FIG. 3 is a rear view of a variable valve lift apparatus according to an exemplary embodiment of the present invention.

FIG. 1 is a perspective view of a variable valve lift apparatus according to an exemplary embodiment of the present invention, FIG. 2 is a top plan view of a variable valve lift apparatus according to an exemplary embodiment of the present invention, and FIG. 3 is a rear view of a variable valve lift apparatus according to an exemplary embodiment of the present invention.

As shown in FIG. 1 to FIG. 3, a variable valve lift apparatus according to an exemplary embodiment of the present invention includes an outer body 10, a first inner body 20, a roller 60, a second inner body 30, connecting shaft 40, a first lost motion spring 50 and a second lost motion spring 51.

The outer body 10 is adapted to make a lever motion by selectively receiving torque of a camshaft, and is operated to open/close a valve. In addition, a plurality of cams is formed or disposed at the camshaft so as to transform rotational motion of the camshaft to lever motion of the outer body 10. Herein, the valve is an intake valve or an exhaust valve of an engine. Further, two spaces 12 and 13 that the outer body 10 is penetrated in a vertical direction is formed inside of the outer body 10. That is, the outer body 10 has a set length so as to make a lever motion, and has a set width and a set thickness so as to form the two inside spaces 12 and 13 of the outer body 10. Herein, one of two inside spaces 12 and 13 of the outer body 10 will be called "first inside space 12", and the other one will be called "second inside space 13".

The valve is connected to one end of the outer body 10, and a rotation axis of the lever motion is disposed at the other end thereof. Herein, it is well known to a person of an ordinary skill in the art that a rotation axis of the lever motion of the outer body 10 is a pivot axis based on a hydraulic lash adjuster (HLA) 90 and 95. In addition, the first inside space 12 and the second inside space 13 are respectively opened toward one end of the outer body 10, so an entire shape of the outer body 10 may be formed in an "E" shape. Further, a partition 19 is formed at the outer body 10 so as to partition the first inside space 12 and the second inside space 13 such that the outer body 10 is formed in the "E" shape.

In the following description, first ends and second ends of the components disposed on or coupled to the outer body 10 mean portions in the same directions as the first end and the second end of the outer body 10.

The first inner body 20 is disposed in the first inside space 12 of the outer body 10. In addition, one end of the first inner body 20 is rotatably connected with the one end of the outer body 10. Further, the first inner body 20 is adapted to make a lever motion by receiving torque of the camshaft, and is operated to selectively open/close a valve. Furthermore, a space 24 that the first inner body 20 is penetrated in a vertical direction is formed inside of the first inner body 20. That is, the first inner body 20 has a set length so as to make a lever motion, and has a set width and a set thickness so as to form the inside space 24 of the inner body 20.

The roller 60 is disposed in the inside space 24 of the first inner body 20. In addition, the roller 60 is rotatably connected with the first inner body 20. Further, the roller 60 is rolling-contacted with any one of the plurality of cams so as to transform rotational motion of the camshaft to lever motion of the outer body 10 or the inner body 20.

The second inner body 30 is disposed in the second inside space 13 of the outer body 10. In addition, one end of the second inner body 30 is rotatably connected with the one end of the outer body 10. Further, the second inner body 30 makes a lever motion by receiving torque of the camshaft to selectively open/close a valve. Furthermore, the second inner body 30 is rolling-contacted with the other one of the plurality of cams. That is, the second inner body 30 has a set length to pivot and has set width and thickness to rolling-contact with the other one cam.

The connecting shaft 40 is provided so as to rotatably connect the one end of the first inner body 20 and the one end of the second inner body 30 with the one end of the outer body 10. That is, the first inner body 20 and the second inner body 30 may make a relative rotation with the outer body 10 around the connecting shaft 40. Herein, the one end of the outer body 10 being connected with the first and second inner body 20 and 30 by the connecting shaft 40 will be called "outer connecting portion 14", and the one end of the first inner body 20 being connected with the outer body 10 by the connecting shaft 40 will be called "first inner connecting portion 22", and the one end of the second inner body 30 being connected with the outer body 10 by the connecting shaft 40 will be called "second inner connecting portion 32". That is, the connecting shaft 40 penetrates the outer connecting portion 14, the first inner connecting portion 22, and the second inner connecting portion 32.

A valve contact portion 16, which is protruded from the outer connecting portion 14, is formed at the one end of the outer body 10. The outer connecting portion 14 is formed at both sides of the opened one end of the outer body 10 to be provided by two. Therefore, the valve contact portion 16 is respectively formed at and protruded from the two outer connecting portion 14 to be provided by two. In addition, the two valve contact portions 16 are respectively contacted to the valve so as to push two valves by the lever motion of the outer body 10.

Meanwhile, a seating portion 11, where the hydraulic lash adjuster 90 and 95 is seated on, is formed at the other end of the outer body 10.

The seating portion 11 may be formed by two to be protruded toward both sides from the other end of the outer body 10. A seating groove 15 and 17, where the each one hydraulic lash adjuster 90 and 95 is seated on, is respectively formed at the two seating portion 11. That is, the variable valve lift apparatus according to an exemplary embodiment of the present invention is a three-point supported variable valve lift apparatus which is supported by the two valves and the two hydraulic lash adjusters 90 and 95.

Herein, the seating groove 15 which is formed near the first inner body 20 will be called "first seating groove 15", and the seating groove 17 which is formed near the second inner body 30 will be called "second seating groove 17". In addition, the hydraulic lash adjuster 90 which is seated on the first seating groove 15 will be called "first lash adjuster 90", and the hydraulic lash adjuster 95 which is seated on the second seating groove 17 will be called "second lash adjuster 95". The hydraulic lash adjusters 90 and 95, a device that supplies hydraulic pressure to operate a variable valve lift apparatus and allows a valve lifter to move in close contact with a cam, is well known to those skilled in the art, so the detailed description is not provided.

When the first inner body 20 is fixed to the outer body 10, the first inner body 20 and the outer body 10 make a lever motion together around the rotation axis of the outer body 10 lever motion by rotation of the any one cam rolling-contacted to the roller 60. In addition, only the first inner body 20 makes a lever motion around the connecting shaft 40 by rotation of the cam rolling-contacted with the roller 60 when the first inner body 20 fixed to the outer body 10 is released.

When the second inner body 30 is fixed to the outer body 10, the second inner body 30 and the outer body 10 make a lever motion together around the rotation axis of the outer body 10 lever motion by the other one cam rolling-contacted with the second inner body 30. In addition, only the second inner body 30 makes a lever motion around the connecting shaft 40 by rotation of the other one cam when the second inner body 30 fixed to the outer body 10 is released.

Profiles of the any one cam being rolling-contacted with the roller 60 and the other one cam being rolling-contacted with the second inner body 30 are different with each other. Therefore, a valve lift to be different with each other is realized in case the first inner body 20 and the outer body 10 make a lever motion together by the cam being rolling-contacted with the roller 60 and in case the second inner body 30 and the outer body 10 make a lever motion together by the cam being rolling-contacted with the second inner body 30. Herein, the different valve lifts may be a normal lift and a high lift.

A zero lift of the valve is realized in case the first inner body 20 makes a lever motion around the connecting shaft 40 by the cam being rolling-contacted with the roller 60 and simultaneously the second inner body 30 makes a lever motion around the connecting shaft 40 by the cam being rolling-contacted with the second inner body 30. Thus, the cylinder deactivation is performed.

In case the first inner body 20 is released from the outer body 10, the first lost motion spring 50 functions to return the first inner body 20 which is made by a relative rotation with the outer body 10 by a lever motion. In addition, the first lost motion spring 50 is disposed to be coiled around the connecting shaft 40.

The first lost motion spring 50 forms an outer fixing portion 52 which is fixed to the outer body 10 and an inner fixing portion 54 which is fixed to the first inner body 20. In addition, the outer fixing portion 52 may extend along a width direction of the outer body 10 to not be interfered by the first inner body 20, and may be fixed to the outer connecting portion 14 of the outer body 10. Herein, the outer fixing portion 52 may be fixed to the outer body 10 by being fixed to the connecting shaft 40 in case that the outer body 10 is integrally formed with the connecting shaft 40.

In case the second inner body 30 is released from the outer body 10, the second lost motion spring 51 functions to return the second inner body 30 which is made by a relative rotation with the outer body 10 by a lever motion. In addition, the second lost motion spring 51 is disposed to be coiled around the connecting shaft 40.

The second lost motion spring 51 forms an outer fixing portion 53 which is fixed to the outer body 10 and an inner fixing portion 55 which is fixed to the second inner body 30. In addition, the outer fixing portion 53 may extend along a width direction of the outer body 10 to not be interfered by the second inner body 30, and may be fixed to the outer connecting portion 14 of the outer body 10. Herein, the outer fixing portion 53 may be fixed to the outer body 10 by being fixed to the connecting shaft 40 in case that the outer body 10 is integrally formed with the connecting shaft 40.

As the first and second lost motion springs 50 and 51 are disposed to be coiled around the connecting shaft 40, the first and second lost motion springs 50 and 51 are easily fixed to the first and second inner bodies 20 and 30, and additional constituent elements for connecting the first and second lost motion springs 50 and 51 with the outer body 10 or the first and second inner bodies 20 and 30 are not required.

For instance, the first lost motion spring 50 is disposed to be coiled around the rotation axis of the outer body 10 lever motion and one part of the first lost motion spring 50 is connected with the first inner body 20 through a rotation shaft of the roller 60, length of the roller rotation shaft 65 may become long and additional constituent elements for coiling the first lost motion spring 50 around the rotation axis of the outer body 10 lever motion may be required.

The connecting shaft 40 is disposed to penetrate the outer connecting portion 14 of the outer body 10. In addition, as the valve contact portion 16 is formed to protrude toward both sides along a width direction of the outer body 10 from the outer connecting portion 14, length of the connecting shaft 40 and an entire width of the outer body 10 to except the valve contact portion 16 may be reduced.

Figure 4:
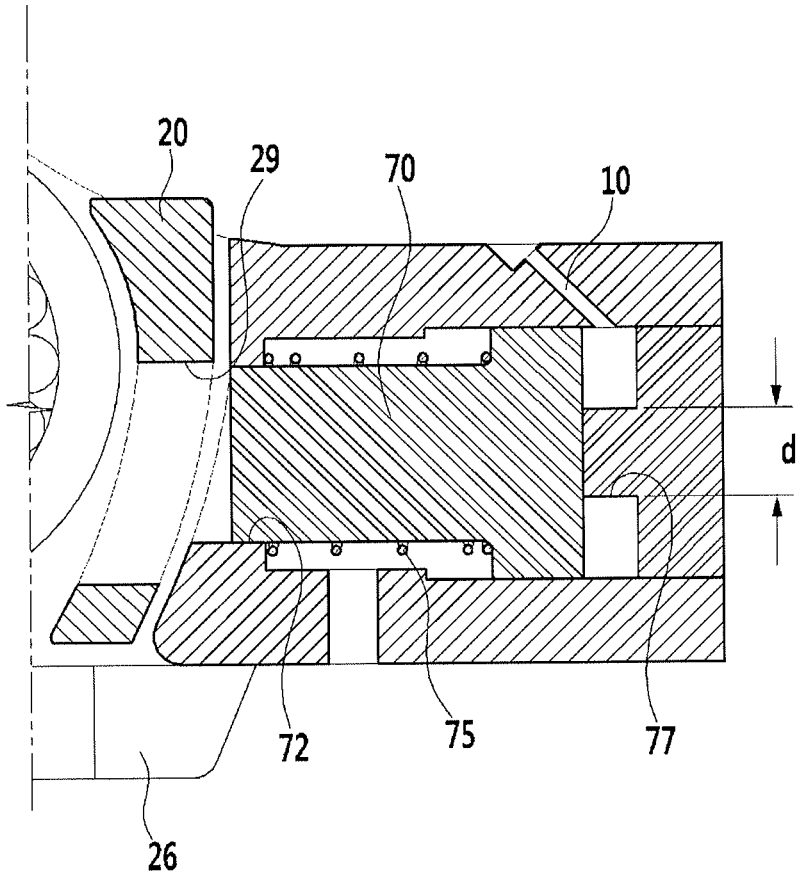
FIG. 4 is a cross-sectional view along a line A-A of FIG. 2.

FIG. 4 is a cross-sectional view along a line A-A of FIG. 2. In addition, FIG. 4 shows composition for selectively fixing the first inner body 20 to the outer body 10.

As shown in FIG. 4, the first inner body 20 further includes a stopper 26 and a latching pin hole 29, and a first latching pin 70, a first guide hole 72, a hydraulic pressure supply hole 77, and a first latching spring 75 are formed or disposed at the outer body 10.

The stopper 26 is formed to be protruded from the other end of the first inner body 20 such that the other end of the first inner body 20 is blocked by the other end of the outer body 10 when the first inner body 20 reaches to an original position by the first lost motion spring 50 (Referring to FIG. 1 and FIG. 3). Therefore, the first inner body 20 can be stably returned by the first lost motion spring 50.

Figure 5:
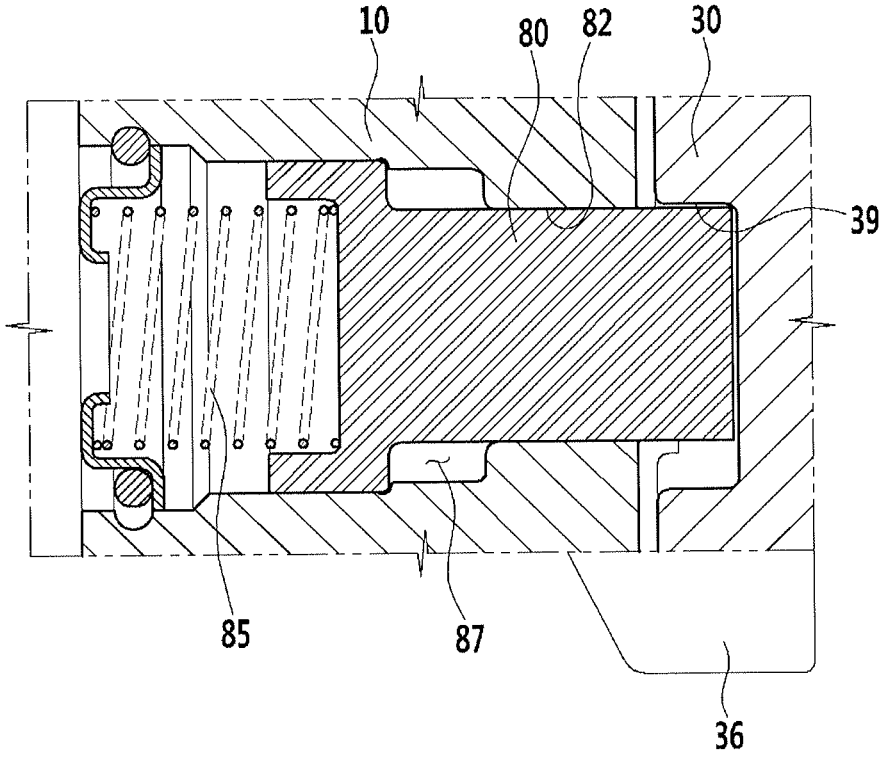
FIG. 5 is a cross-sectional view along a line B-B of FIG. 2.

The latching pin hole 29 is a hole formed at the other end of the first inner body 20 such that a latching member, which functions to selectively fix the first inner body 20 to the outer body 10, such as the first latching pin 70 is inserted thereinto. In FIG. 4 and FIG. 5, the latching member is illustrated to the first and second latching pin 70 and 80 as a normal latching pin, but it is not limited thereto. The first latching pin 70 is operated by hydraulic pressure, and may be disposed at the other end side of the outer body 10 for easily receiving hydraulic pressure.

The first guide hole 72 is a hole formed at the other end side of the outer body 10 so as to guide a piston motion of the first latching pin 70. In addition, the first guide hole 72 is formed to close to the latching pin hole 29 at one end side of the first latching pin 70 on the other end side of the outer body 10.

The hydraulic pressure supply hole 77 is a hole formed at the other end side of the outer body 10 so as to supply hydraulic pressure to the first latching pin 70. In addition, the hydraulic pressure supply hole 77 is formed at the other end side of the first latching pin 70 on the other end side of the outer body 10 such that the first latching pin 70 is pushed toward the first inner body 20 by hydraulic pressure being supplied. Further, the first latching pin 70 is pushed toward the one end of the outer body 10 by hydraulic pressure supplied through the hydraulic pressure supply hole 77 and is inserted into the latching pin hole 29 of the first inner body 20 passing through the first guide hole 72 of the outer body 10 such that the first inner body 20 is fixed to the outer body 10. Herein, an interior diameter (d) of the hydraulic pressure supply hole 77 may designed by a person of an ordinary skill in the art for optimizing responsiveness of the first latching pin 70 which is operated by supplying hydraulic pressure.

The first latching spring 75 is provided to return the first latching pin 70 to the position before it is pushed by the hydraulic pressure and is disposed between the first guide hole 72 and the other end of the first latching pin 70. That is, when hydraulic pressure being supplied through the hydraulic pressure supply hole 77 is released, the first inner body 20 and the outer body 10 are unfixed to each other as the first latching pin 70 is returned by the first latching spring 75.

When the first inner body 20 is fixed to the outer body 10, the high lift of the valve is realized by the outer body 10 which makes a lever motion together with the first inner body 20.

FIG. 5 is a cross-sectional view along a line B-B of FIG. 2. In addition, FIG. 5 shows composition for selectively fixing the second inner body 30 to the outer body 10.

As shown in FIG. 5, the second inner body 30 further includes a stopper 36 and a latching pin hole 39, a second latching pin 80, a second guide hole 82, a second latching spring 85, and a hydraulic pressure chamber 87 are formed or disposed at the outer body 10.

The stopper 36 is formed to be protruded from the other end of the second inner body 30 such that the other end of the second inner body 30 is blocked by the other end of the outer body 10 when the second inner body 30 reaches to an original position by the second lost motion spring 51 (Referring to FIG. 1 and FIG. 3). Therefore, the second inner body 30 can be stably returned by the second lost motion spring 51.

The latching pin hole 39 is a hole formed at the other end of the second inner body 30 such that the second latching pin 80 is inserted thereinto. The second latching pin 80 is operated by hydraulic pressure, and may be disposed at the other end side of the outer body 10 so as to easily receive hydraulic pressure.

The second guide hole 82 is a hole formed the other end side of the outer body 10 so as to guide a piston motion of the second latching pin 80. In addition, the second guide hole 82 is formed to close to the latching pin hole 39 at one end side of the second latching pin 80 on the other end side of the outer body 10.

The second latching pin 80 is inserted into the latching pin hole 39 by elastic force of the second latching spring 85 such that the second inner body 30 is fixed to the outer body 10. That is, the second latching spring 85 is disposed at the other end side the second latching pin 80 so as to push the second latching pin 80 toward the second inner body 30. In addition, a hydraulic pressure chamber 87 which is surrounded by the outer body 10 and the second latching pin 80 is formed at the one end side of the second latching pin 80. Further, the second latching pin 80 is pushed toward the other end of the outer body 10 by hydraulic pressure supplied to the hydraulic pressure chamber 87 such that the second inner body 30 and the outer body 10 are unfixed to each other. In other words, in case hydraulic pressure supplied to the hydraulic pressure chamber 87 is released, the second inner body 30 is fixed to the outer body 10 as the second latching pin 80 is returned so as to be inserted into the latching pin hole 39 passing through the second guide hole 82 by the second latching spring 85.

When the second inner body 30 is fixed to the outer body 10, the normal lift of the valve can be realized by the outer body 10 which makes a lever motion together with the second inner body 30. At this time, the normal lift of the valve is realized in case the first inner body 20 and the outer body 10 are unfixed to each other. In addition, if the first inner body 20 and the outer body 10 are unfixed to each other and simultaneously the second inner body 30 and the outer body 10 are unfixed to each other, the zero lift of the valve is realized as the outer body 10 does not make a lever motion.

Meanwhile, tolerance between the first and second latching pins 70 and 80 and the latching pin hole 29 and 39 can be precisely optimized as the stopper 26 and 36 is to be base when the outer body 10 and the first and second inner body 20 and 30 are manufactured.

Figure 6:
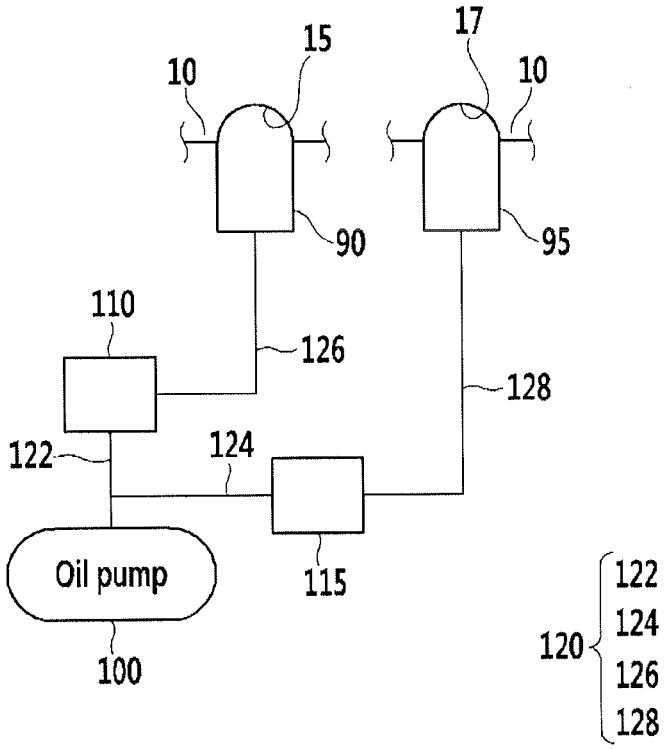
FIG. 6 is a block diagram of a hydraulic pressure supply system according to an exemplary embodiment of the present invention.

FIG. 6 is a block diagram of a hydraulic pressure supply system according to an exemplary embodiment of the present invention.

As shown in FIG. 6, the variable valve lift apparatus according to an exemplary embodiment of the present invention further includes a hydraulic pump 100, a first oil control valve 110, a second oil control valve 115, and an oil line 120.

The hydraulic pump 100 pumps oil so as to generate hydraulic pressure for operating the first and second latching pins 70 and 80. The hydraulic pump 100 is well known to a person of an ordinary skill in the art, so detailed descriptions thereof will be omitted.

The first oil control valve 110 controls such that hydraulic pressure receiving from the hydraulic pump 100 is selectively supplied to the first lash adjuster 90 which is seated on the first seating groove 15.

The second oil control valve 115 controls so as to selectively supply hydraulic pressure receiving from the hydraulic pump 100 to the second lash adjuster 95 which is seated on the second seating groove 17.

The first and second oil control valves 110 and 115 are general oil control valves (OCV), basic composition and function of the first and second oil control valve 110 and 115 are well known to a person of an ordinary skill in the art such that detailed descriptions thereof will be omitted.

The oil line 120 includes first, second, third, and fourth oil lines 122, 124, 126, and 128. The first oil line 122 communicates the hydraulic pump 100 with the first oil control valve 110. The second oil line 124 is branched from first oil line 122 so as to be communicated to the second oil control valve 115. The third oil line 126 communicates the first oil control valve 110 with the first lash adjuster 90. The fourth oil line 128 communicates the second oil control valve 115 with the second lash adjuster 95.

According to an exemplary embodiment of the present invention, the valve lift can be realized by 3 steps as two inner bodies 20 and 30 are respectively and selectively fixed to the outer body 10. In addition, weight and cost may be decreased and spatial utility and dynamic characteristic may be improved as the lost motion spring 50 is disposed at the valve contact portion 16 side such that length of the connecting shaft 40 and the roller rotating shaft 65 is to be short and an entire size of the variable valve lift apparatus is reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus which is driven to vary lift of a valve disposed at an engine, the variable valve lift apparatus comprising:

an outer body selectively making a lever motion according to rotation of a cam and being adapted such that the valve is connected with a first end thereof and a pivot axis of the lever motion is disposed at a second end thereof;

a first inner body disposed in inside space of the outer body and adapted such that a first end thereof rotatably connected with the first end of the outer body;

a second inner body disposed in inside space of the outer body and adapted such that a first end thereof rotatably connected with the first end of the outer body;

a connecting shaft disposed to penetrate the first end of the outer body, the first end of the first inner body, and the first end of the second inner body and connect the outer body with the first and second inner bodies;

a first lost motion spring provided to return the first inner body which is relatively rotated with the outer body around the connecting shaft; and a second lost motion spring provided to return the second inner body which is relatively rotated with the outer body around the connecting shaft, wherein the cam comprises two cams, the first inner body is selectively fixed to the outer body to make a lever motion together with the outer body around the pivot axis of an outer body lever motion depending on rotation of a first cam of the two cams or is selectively released from fixing with the outer body to make a lever motion around the connecting shaft depending on rotation of the first cam, and the second inner body is selectively fixed to the outer body to make a lever motion together with the outer body around the pivot axis of the outer body lever motion depending on rotation of a second cam of the two cams or is selectively released from fixing with the outer body to make a lever motion around the connecting shaft depending on rotation of the second cam, a hydraulic pump generating hydraulic pressure;

a first latching pin disposed at the outer body and operated to selectively fix the first inner body to the outer body by hydraulic pressure being generated by the hydraulic pump;

a second latching pin disposed at the outer body and operated to selectively fix the second inner body to the outer body by hydraulic pressure being generated by the hydraulic pump;

a first oil control valve controlling hydraulic pressure receiving from the hydraulic pump to be selectively supplied to the first latching pin; and a second oil control valve controlling hydraulic pressure receiving from the hydraulic pump to be selectively supplied to the second latching pin, wherein zero lift of the valve is realized when the first inner body and the outer body are unfixed to each other and the second inner body and the outer body are unfixed to each other.

2. The variable valve lift apparatus of claim 1, wherein the outer body forms valve contact portions which are protruded from both sides of the first end thereof to respectively push one valve by the lever motion and seated portions which are protruded from both sides of the second end thereof to respectively seat one hydraulic lash adjuster.

3. The variable valve lift apparatus of claim 1, wherein the first inner body forms an inside space, and the variable valve lift apparatus further comprises a roller which is disposed in the inside space of the first inner body, is rotatably connected with the first inner body, and is rolling-contacted to the first cam such that the first inner body makes the lever motion depending on rotation of the first cam.

4. The variable valve lift apparatus of claim 1, wherein a stopper is respectively formed at a second end of the first inner body and a second end of the second inner body to be protruded for blocking a second end of the outer body when the first and second inner bodies are returned.

5. The variable valve lift apparatus of claim 1, wherein the first lost motion spring is disposed to be coiled around the connecting shaft and is adapted such that a first part thereof is fixed to the outer body and a second part thereof is fixed to the first inner body.

6. The variable valve lift apparatus of claim 5, wherein the first part of the first lost motion spring is extended without interference with the first inner body to be fixed the first end of the outer body.

7. The variable valve lift apparatus of claim 1, wherein the second lost motion spring is disposed to be coiled around the connecting shaft and is adapted such that a first part thereof is fixed to the outer body and a second part thereof is fixed to the second inner body.

8. The variable valve lift apparatus of claim 7, wherein the first part of the second lost motion spring is extended without interference by the second inner body to be fixed the first end of the outer body.

9. The variable valve lift apparatus of claim 1, wherein the first latching pin is operated to fix the first inner body to the outer body as being pushed by hydraulic pressure when hydraulic pressure is supplied thereto and unfix the first inner body and the outer body to each other as being pushed by a spring when hydraulic pressure is released therefrom.

10. The variable valve lift apparatus of claim 1, wherein the second latching pin is operated to unfix the second inner body and the outer body to each other as being pushed by hydraulic pressure when hydraulic pressure is supplied thereto and fix the second inner body to the outer body as being pushed by a spring when hydraulic pressure is released therefrom.

11. The variable valve lift apparatus of claim 1, wherein high lift of the valve is realized in case the first inner body is fixed to the outer body.

12. The variable valve lift apparatus of claim 1, wherein normal lift of the valve is realized in case the first inner body and the outer body are unfixed to each other and the second inner body is fixed to the outer body.

* * * * *